United States Patent [19]

Morikawa et al.

[11] Patent Number: 4,527,021

[45] Date of Patent: Jul. 2, 1985

[54] KEYBOARD SWITCH ASSEMBLY

[75] Inventors: Yoshitsugu Morikawa, Tokyo; Kiyoshi Nomoto; Kenichi Okada, both of Saitama, all of Japan

[73] Assignee: Shin-Etsu Polmer Co., Ltd., Tokyo, Japan

[21] Appl. No.: 576,872

[22] Filed: Feb. 3, 1984

Related U.S. Application Data

[63] Continuation-in-part of Ser. No. 397,065, Jul. 12, 1982, abandoned.

[30] Foreign Application Priority Data

Jul. 15, 1981 [JP] Japan ..... 56-104987[U]

[51] Int. Cl.[3] ..... H01H 13/70

[52] U.S. Cl. ..... 200/5 A; 200/159 B; 200/264

[58] Field of Search ..... 200/5 A, 159 B, 264, 200/265, 292, 306, 243

[56] References Cited

U.S. PATENT DOCUMENTS

| | | | |
|---|---|---|---|
| 3,120,583 | 2/1964 | Cornell, III | 361/416 |
| 3,699,294 | 10/1972 | Sudduth | 200/292 X |
| 3,742,157 | 6/1973 | Leposavic | 200/5 A |
| 3,806,471 | 4/1974 | Mitchell | 200/264 |
| 3,969,600 | 7/1976 | Sims, Jr. | 200/5 A X |
| 3,983,355 | 9/1976 | Hyodo | 200/264 X |
| 3,987,259 | 10/1976 | Larson | 200/5 A |
| 4,046,975 | 9/1977 | Seeger, Jr. | 200/5 A |
| 4,207,443 | 6/1980 | Matsuura | 200/5 A |
| 4,243,861 | 1/1981 | Strandwitz | 200/5 A X |
| 4,249,044 | 2/1981 | Larson | 200/306 X |
| 4,293,754 | 10/1981 | Komaki | 200/5 A X |
| 4,302,648 | 11/1981 | Sado et al. | 200/5 A X |
| 4,338,502 | 7/1982 | Hashimoto et al. | 200/5 A X |

*Primary Examiner*—J. R. Scott

*Attorney, Agent, or Firm*—Toren, McGeady, Stanger

[57] ABSTRACT

A key-board switching unit for electronic instruments is constructed with a printed circuit board provided with a plural number of pairs of fixed contact points on the surface and an insulating covering sheet member mounted on or above the printed circuit board and provided on the bottom surface with movable contact points to face the fixed contact points. Different from conventional units in which exact correspondence in the positions of the fixed and movable contact points is required with time- and labor-consuming assembling works, the movable contact points in multiple numbers distributed over the whole bottom surface of the covering sheet member in such a manner that, when the covering sheet member is pushed and depressed at the switching position, the fixed contact points forming a pair of the counter-electrodes are contacted and electrically connected with at least one movable contact point even without exact positioning of the covering sheet member and the printed circuit board to give a great advantage of the increased productivity in the works of assembling. In particular, the movable contact points are formed of a pressure-sensitive electroconductive rubber.

7 Claims, 17 Drawing Figures

FIG.5a
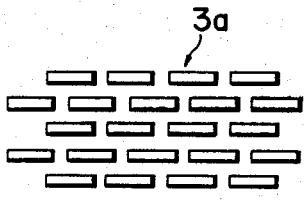
FIG.5c
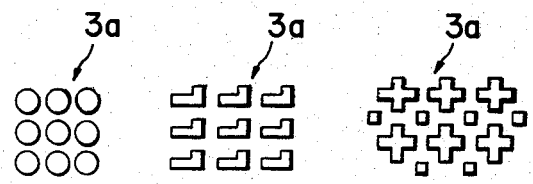
FIG.5b
FIG.5d
FIG. 6
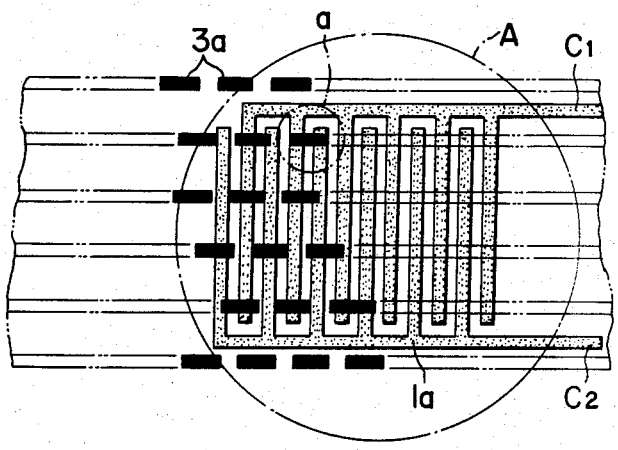

KEYBOARD SWITCH ASSEMBLY

BACKGROUND OF THE INVENTION

This is a continuation-in-part application from the copending U.S. application Ser. No. 397,065 filed July 12, 1982 now abandoned.

The present invention relates to a novel and improved key-board switching unit or, more particularly, to a key-board switching unit with a remarkably small thickness suitable for use in a compactly designed electronic instrument.

It is a trend in recent years that many of electronic instruments such as small-sized computers of table-top type and the like are designed to have smaller and smaller weight and thickness. As for the key-board switching units used in such small-sized electronic instruments, in particular, conventional push-button type ones are increasingly being replaced with the so-called buttonless key-board switching units having a flat surface with no push buttons protruded thereon with an object to decrease the overall thickness of the unit.

Such a buttonless key-board switching unit hitherto used has typically a structure in which a printed circuit board provided with a plurality of pairs of fixed contact points thereon is overlaid with an insulating covering sheet member bearing a plurality of movable contact points on the bottom surface each at the position to face a pair of the fixed contact points with intervening spacers therebetween to provide the space for the stroke of the movable contact points. The covering sheet member is usually further overlaid and integrated with a display sheet indicating the pushing positions on the movable contact points below. When the covering sheet member is pushed with a finger tip or the like at the pushing position, the covering sheet member is elastically deformed and depressed to bring the movable contact point into contact with the paired fixed contact points on the printed circuit board closing the electric circuit therebetween while the circuit is opened when the pushing finger tip is released by the elastic rebound of the covering sheet member to its original form.

The fixed contact points on the circuit board of a conventional key-board switching unit are usually formed in a comb-like pattern with several teeth in parallel because a pair of the fixed contact points in such a pattern is advantageous in obtaining very reliable contacting and electric connection between the fixed and movable contact points even at the corners of the movable contact point, usually, made of an electroconductive rubber when it is depressed by pushing to be brought into contact with the fixed contact points below it.

In the above described conventional key-board switching units, however, there may be a problem or disadvantage that, when the printed circuit board is provided with a plural number of pairs of the fixed contact points, the movable contact points on the bottom surface of the covering sheet member must be provided at the positions exactly facing the individual pairs of the fixed contact points below since otherwise the reliability in the contacting therebetween is greatly decreased. Furthermore, the size of each of the movable contact points should be modified according to the configuration of the fixed contact points with which it is to be brought into contact. In addition, the cost for assembling a conventional key-board switching unit is necessarily high due to the large consumption of labor and time for the assembling work because exact positioning is indispensable for each of the combinations of the fixed and movable contact points provided on the circuit board and the covering sheet member, respectively.

SUMMARY OF THE INVENTION

It is therefore an object of the present invention to provide a novel and improved key-board switching unit freed from the above described problems and disadvantages in the key-board switching units known in the prior art.

The key-board switching unit of the invention comprises (a) a printed circuit board provided with a plural number of pairs of fixed contact points on a surface thereof, and (b) an insulating covering sheet member provided, on the bottom surface thereof, with a multiplicity of electroconductive members formed of a pressure-sensitive electroconductive rubber, the size of each of the conductive members being sufficiently small in comparison with the dimensions of the fixed contact points, as the movable contact points distributed over whole surface and supported above the printed circuit board so that a switch is formed with each pair of the fixed contact points on the printed circuit board, the density of distribution of the conductive members being sufficiently large to ensure that at least one conductive member is in contact with the fixed contact points to bridge therebetween when the covering sheet member is pressed toward the printed circuit board.

BRIEF DESCRIPTION OF THE DRAWING

FIGS. 5*a*, 5*b*, 5*c*, and 5*d* each shows a different pattern of the electroconductive members as the movable contact points distributed on the bottom surface of the covering sheet member.

FIG. 6 is a plan view illustrating the relative positions of a pair of the fixed contact points and a plural number of the movable conductive members.

DETAILED DESCRIPTION OF THE PREFERRED EMBODIMENTS

In the following, the inventive key-board switching unit is described in detail with reference to the accompanying drawing.

Figure 1:
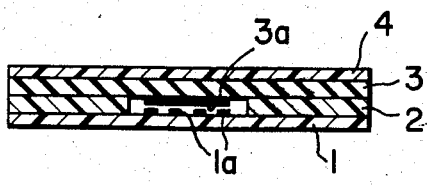
PRIOR ART FIG. 1
FIGS. 1 to 3 are each a cross sectional view illustrating a different thinly-designed key-board switching unit in the prior art.
Figure 2:
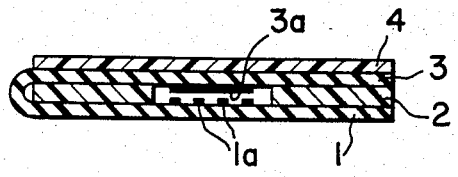
PRIOR ART FIG. 2
Figure 3:
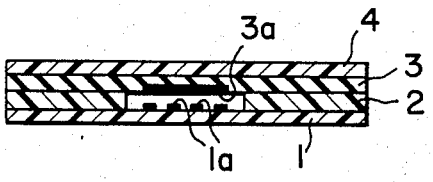
PRIOR ART FIG. 3

Firstly, FIGS. 1 to 3 each illustrate a cross sectional view of a conventional thin key-board switching unit which is constructed with a printed circuit board 1 provided with a pair of fixed contact points 1*a* on the surface thereof and covered with a covering sheet member 3 provided with a movable contact point 3*a* on the bottom surface thereof and supported above the printed circuit board 1 by the spacer 2 to form a space for key stroke therebetween. The covering sheet member 3 is usually overlaid and integrated with a display sheet 4 indicating the respective pushing positions of the switches on the top surface of the covering sheet member 3.

Figure 4:
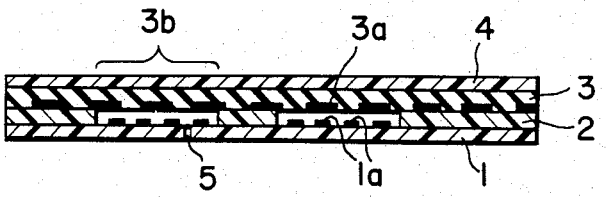
FIG. 4 is a cross sectional view of a thin key-board switching unit according to the invention.

FIG. 4 illustrates a cross section of a typical embodiment of the inventive key-board switching unit which is also constructed with a printed circuit board 1 provided with a printed wiring of the circuit (not shown in the figure) and a plural number of pairs of the fixed contact points 1*a* for the switches and a covering sheet member 3 supported above the printed circuit board 1 by the insulating spacer 2 to form a space for key stroke between each pair of the fixed contact points 1*a* and the covering sheet member 3. The covering sheet member 3 is provided on the bottom surface thereof with a multiplicity of the electroconductive members 3*a* as the movable contact points distributed over substantially the whole bottom surface of the covering sheet member 3 so that a switch is formed with each pair of the fixed contact points and at least one or a plural number of the electroconductive members 3*a* as the movable contact points facing the fixed contact points 1*a*. The covering sheet member 3 is overlaid by and integrated with a display sheet 4 indicating the pushing positions 3*b* above the fixed contact points 1*a* to operate the switch. The printed circuit board 1 is preferably provided with one or more of the air escapes or vents 5 communicating with the otherwise closed space for key stroke to ensure quick operation of the switch.

The covering sheet member 3 in the inventive key-board switching unit can be made of any insulating material having elastic resilience including various kinds of natural and synthetic rubbers as well as synthetic resins. Silicone rubbers are particularly preferred by virtue of the excellent electric characteristics including anti-arc resistance, weathering resistance, durability and the like properties.

On the other hand, the electroconductive members 3*a* are formed by adhesively bonding small pieces of a metal or other conductive materials such as, preferably, an electroconductive silicone rubber impregnated with a large volume of a conductive particulate filler, e.g. carbon black or a metal powder, to be imparted with electroconductivity. Alternatively, the electroconductive members 3*a* can be formed by printing or coating with an electroconductive paint. It is also preferable that the conductive members 3*a* are formed of a pressure-sensitively electroconductive rubber having a volume resistivity of, for example, $10^7$ to $10^5$ ohm.cm when no compressive force is applied and a volume resistivity of $10^4$ to $10^2$ ohm.cm when under compression by a finger tip to give a pushing force of 10 to 25 g per each switching position.

Different from conventional key-board switching units in which the covering sheet member 3 is provided with one or a limited number of the electroconductive members 3*a* as the movable contact point for each of the switches involved in the unit facing the respective pair of the fixed contact points on the circuit board, the inventive key-board switching unit is characterized by the sporadic distribution of discrete small areas of the electroconductive members 3*a* as the movable contact points provided substantially over the whole bottom surface of the covering sheet member 3. The pattern of the sporadic distribution of the electroconductive members 3*a* is not particularly limitative and several of the patterns are shown in FIGS. 5*a*–5*d* though not limited thereto. It is preferable that the discrete small areas of the electroconductive members 3*a* are distributed in a regular manner as shown in FIGS. 5*a*–5*d* in consideration of manufacturing efficiency.

The size and form of each of the above mentioned discrete areas of the electroconductive members 3*a* as well as the distribution density thereof on the covering sheet member or the distance between the adjacently positioned discrete areas are determined in consideration of the size and form of the fixed contact points 1*a* and the distance between the pair of the fixed contact points 1*a* to be electrically connected by one or more of the electroconductive members 3*a* on the covering sheet member 3 when the covering sheet member 3 is depressed at the switching position.

As is illustrated in FIG. 4, the exposed surface of each of the discrete electroconductive members 3*a* and the bottom surface of the covering sheet member 3 are flush with each other. In other words, the conductive members 3*a* are embedded in the covering sheet member 3 so that the integrated body of the sheet member 3 and the conductive members 3*a* has a flat bottom surface. This type of the covering sheet member is advantageous when reduction of the thickness of the switching unit and a higher density of switches on the key board switching unit are desired.

Figure 12:
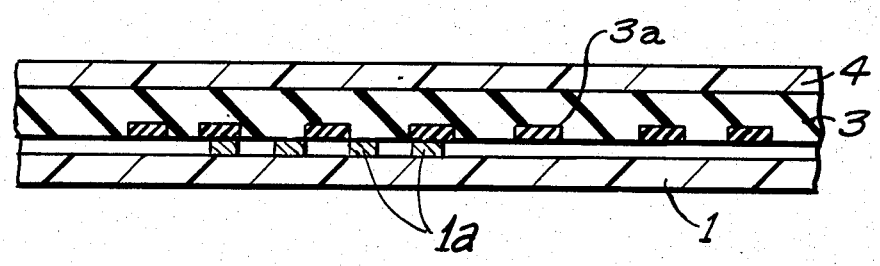
FIGS. 12, 13 and 14 are partial cross-sectional views of additional embodiments of the present invention.

When the conductive member 3*a* is formed of a pressure-sensitive electroconductive rubber as is mentioned above, a unique thin design is possible in the inventive key-board switching unit which may have a thickness of only 5 to 0.2 mm. That is, the covering sheet member 3 provided with a multiplicity of the sporadically distributed conductive members 3*a* is directly put on the circuit board 1 provided with the fixed contact points 1*a* in contact therewith without a spacer to cause no short circuiting or electric leakage in the absence of a pushing force while the desired electric conduction is obtained when a pushing force is applied on to the pushing position of the switching unit of the invention by virtue of the increased conductivity of the member 3*a* by the compressive force, note FIG. 12. In addition to the extremely small thickness of the switching unit above mentioned, such a direct contact of the covering sheet member 3 and the printed circuit board 1 is advantageous because no space for the key stroke as in the conventional switching units is necessary between them so that the electric leakage by dew condensation and switching errors by the intervention of dust can be minimized.

Figure 13:
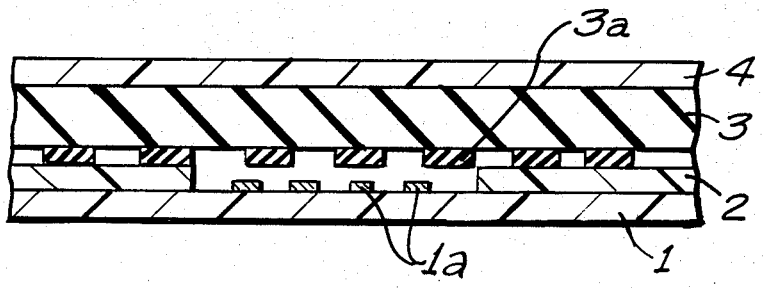
Figure 14:
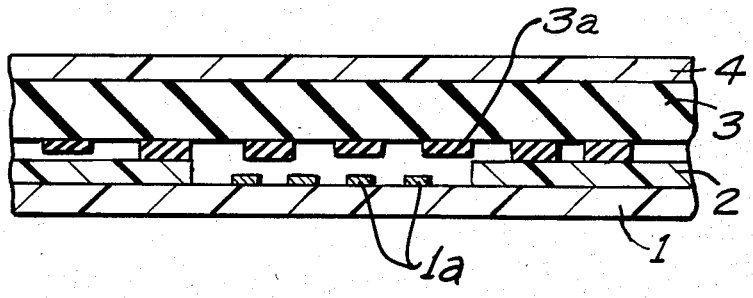

It is of course optional, as in the prior art, to have each of the discrete conductive members 3*a* protruded downwardly out of the bottom surface of the covering sheet member 3, for example, in a stud-like, truncated conical or pyramidal or other form of protrusion, note FIGS. 13 and 14. In this case, it is preferable that the shoulder portion of the protrusion is not angularly edged but rounded so that advantages are obtained to ensure softness of the touch at the contact of the conductive member 3*a* to the fixed contact points 1*a* on the circuit board 1 along with the decrease in the failure of contacting when the switch is pushed in a biased direction. When the conductive member 3*a* has a form of a truncated cone or pyramid of which the top surface is relatively small, an additional advantage is obtained that the contacting area between the conductive member 3*a* and the fixed contact points 1*a* is rapidly increased as the pushing force on the pushing position is increased contributing to a larger rate of increase of the electric current therethrough with improved sensitivity. In this case, it is not always necessary that all of the protrusions of the conductive members 3*a* have the same height but the members 3*a* having two or more different heights are distributed in a random or regular manner, note FIG. 14.

It is further optional that additional protrusions formed of an insulating material, which may be of the same form as the covering sheet member 3, having similar configurations to but having a height of protrusion equal to or larger than the above mentioned protruded conductive members 3*a* are provided among the conductive members 3*a*, which may be protruded out of or embedded in the covering sheet member 3 to be flush on the surface, either at a random or at a regular distribution. Such additional insulating protrusions may serve as a substitute for spacers so that the covering sheet member can be directly put on the circuit board without spacers.

FIG. 6 is a plan view illustrating the relative positions of the fixed contact points 1*a* and the electroconductive members 3*a* as the movable contact points. Within the switching or pushing position indicated by the chain-line circle A, a pair of the fixed contact points 1*a* shown by the sandy-shaded areas, each being in the form of a six-dented comb-like configuration, are provided on the printed circuit board 1 (not shown in FIG. 6) to give the counterposed electrodes $C_1$ and $C_2$ with each of the six teeth of one of the electrodes disposed between and closely to two teeth of the other electrode. Facing this pair of the fixed contact points 1*a*, a multiplicity of electroconductive members 3*a*, as the movable contact points each shown by a small black rectangle, are provided on the bottom surface of the covering sheet member 3 (not shown in FIG. 6). The distribution of these electroconductive members 3*a* is not limited within the pushing position encircled by the chain-line circle A but extends over substantially the whole surface of the covering sheet member 3. In this case, it is a requirement that the electroconductive members 3*a* are distributed in such a manner that, when the covering sheet member 3 is depressed at the pushing position A, the pair of the counterelectrodes $C_1$ and $C_2$ should be contacted and bridged with at least one or, preferably, a plural number of the electroconductive members 3*a* to have the electric circuit closed between them as is shown in the small area encircled with the small circle a. By use of such a covering sheet member 3 provided with a multiplicity of the discrete electroconductive members 3*a* of a suitable size scattered and distributed in a sufficiently large density of, for example, 4 to 25 electroconductive members 3*a* each in the form of 3 mm square per $cm^2$ keeping a distance of 1 mm with each other over the whole bottom surface thereof, a very reliable switching unit having a plural number of switches can be obtained by merely mounting the covering sheet member 3 on the printed circuit board 1 without exact positioning in the assembling of the key-board switching unit.

FIGS. 7 to 11 each illustrate a different embodiment of the inventive key-board switching unit by a cross section including a switch although the principle of these units is the same as in the unit shown in FIG. 4 excepting the omission of the spacer 2 used in FIG. 4 to provide the space for key stroke. Instead, the covering sheet member 3 of each of these units is provided with a dome-like recessed concavity 3*c* on the bottom surface at the position corresponding to the space for key stroke. In this case, it is preferable that each of the concavities as the space for key stroke is provided with one or more of air escapes or vents on one or both of the surfaces of the printed circuit board and the covering sheet member in contact with each other are sand-blasted into a rough surface so as to ensure smooth passage of air into and out of the space and hence smooth operation of the switch.

In the embodiments illustrated in FIGS. 7 to 11, each dome-like concavity provided on the bottom surface of the covering sheet member 3 faces a pair of the fixed contact points 1*a* on the printed circuit board 1. It is, however, optional that a plurality of such concavities are provided on the bottom surface of the covering sheet member 3 in a random but uniform distribution so that at least one of such concavities can face a pair of the fixed contact points when the covering sheet member 3 is mounted on the printed circuit board 1.

Figure 7:
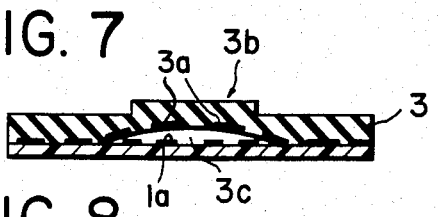
FIGS. 7 to 11 are each a cross sectional view of the inventive thin key-board switching unit with a different cross sectional configuration.

The covering sheet member 3 in the unit shown in FIG. 7 is provided with a button-like raised portion 3*b* indicating the pushing position just above the fixed contact points 1*a* on the printed circuit board 1 with omission of the display sheet 4 in FIG. 4.

Figure 8:
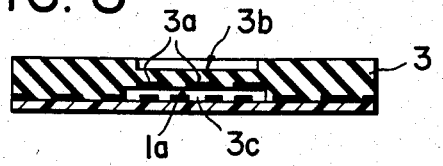

In contrast to the above, the covering sheet member 3 shown in FIG. 8 is provided with a recessed concavity 3*b* on the top surface thereof also indicating the pushing position. The display sheet 4 in FIG. 4 is also omitted.

Figure 9:
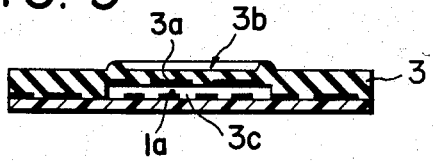

Similarly to FIG. 7, the covering sheet member 3 in FIG. 9 is provided with a raised portion 3*b* to indicate the pushing position on the top surface thereof. The shape of the raised portion or protrusion 3*b* in this case is not button-like but ring-wise or ring shaped. The display sheet 4 in FIG. 4 is also omitted.

Figure 10:
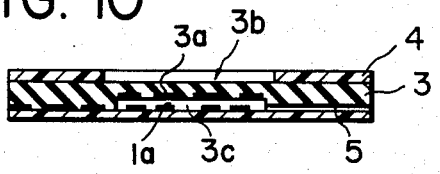

The covering sheet member 3 shown in FIG. 10 is overlaid and integrated with a display sheet 4 but this display sheet 4 is open at the pushing positions 3*b* so that the marks for the indication of the key positions directly printed on the top surface of the covering sheet member 3 as in the key-board switching units illustrated in FIGS. 7 to 9 can be seen through the openings.

Figure 11:
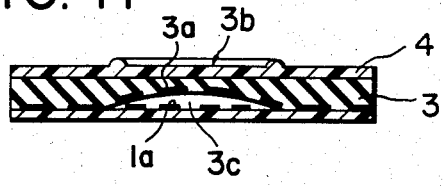

The covering sheet member 3 shown in FIG. 11 is overlaid and integrated with a display sheet 4 which is provided with a ring-wise or ring-shaped protrusion to indicate the pushing position 3*b*.

At any rate, each of the covering sheet members 3 in these key-board switching units illustrated in FIGS. 7 to 11 is provided with a multiplicity of the electroconductive members 3*a* on the bottom surface thereof not only at the positions facing the space 3*c* for key stroke but also over substantially the whole surface.

As is understood from the above description, the key-board switching unit of the invention is constructed with a printed circuit board 1 provided with pairs of fixed contact points 1*a* and an insulating covering sheet member 3 provided with a multiplicity of the electroconductive members 3*a* as the movable contact points on the bottom surface to face the fixed contact points 1*a* with a distribution over whole surface and held above the printed circuit board 1 with a space for key stroke therebetween or in contact with the printed circuit board when the conductive members 3*a* are formed of a pressure-sensitive electroconductive rubber. Therefore, mounting of the covering sheet member 3 on the printed circuit board 1 can be performed to give very reliable switching operation even without the work of time-consuming exact positioning as in the conventional key-board switching units in which exact correspondence of the relative positions is required between the fixed contact points on the printed circuit board and the adequately shaped movable contact points on the bottom surface of the covering sheet member. Therefore, great advantages are obtained with the inventive key-board switching unit not only in the decreased manufacturing costs for the covering sheet member but also in the greatly reduced time and labor for the assembling of the unit.

What is claimed is:

1. A key-board switching unit which comprises (a) a printed circuit board provided with a plural number of pairs of fixed contact points on a first surface thereof, and (b) an insulating covering sheet member having a bottom surface provided with a multiplicity of electroconductive members formed of a pressure-sensitive electroconductive rubber forming movable contact points, said bottom surface arranged facing said first surface, the size of each of the electroconductive members being sufficiently small in comparison with the dimensions of the fixed contact points, the electroconductive members forming the movable contact points are distributed over the whole bottom surface and are supported relative to the printed circuit board so that a switch is formed with each pair of the fixed contact points on the printed circuit board and at least one movable contact point with the density of distribution of the electroconductive members forming the movable contact points being sufficiently large to ensure that at least one electroconductive member is contacted with the fixed contact points to bridge therebetween when the covering sheet member is pressed toward the printed circuit board due to the pressure sensitive electroconductive material forming the electroconductive members.

2. The key-board switching unit as claimed in claim 1 wherein the surface of each of the multiplicity of the electroconductive members facing said surface of said printed circuit board is flush with the bottom surface of the insulating covering sheet member.

3. The key-board switching unit as claimed in claim 2 wherein the insulating covering sheet member provided with the multiplicity of the electroconductive members is mounted on the printed circuit board in direct contact therewith and said electroconductive members due to the pressure-sensitive electroconductive material thereof only forming bridging contact with said fixed contacts when the covering sheet member is pressed toward said printed circuit board.

4. The key-board switching unit as claimed in claim 1 wherein a multiplicity of the electroconductive members are each protruded out of the bottom surface of the covering sheet member.

5. The key-board switching unit as claimed in claim 4 wherein the electroconductive members have the same height of protrusion out of the bottom surface of the covering sheet member.

6. The key-board switching unit as claimed in claim 4 wherein the electroconductive members have different heights of protrusion out of the bottom surface of the covering sheet member.

7. The key-board switching unit as claimed in claim 1 wherein the pressure-sensitive electroconductive rubber has a volume resistivity of $10^7$ to $10^5$ ohm.cm in the absence of a compressive force and $10^4$ to $10^2$ ohm.cm under a compressive force of 10 to 25 g with a finger tip.

* * * * *

UNITED STATES PATENT AND TRADEMARK OFFICE

CERTIFICATE OF CORRECTION

PATENT NO. : 4,527,021

DATED : July 2, 1985

INVENTOR(S) : Yoshitsugu Morikawa, et al

It is certified that error appears in the above-identified patent and that said Letters Patent is hereby corrected as shown below:

In the heading of the patent it should read:

--[73] Assignee: Shin-Etsu Polymer Co., Ltd. Tokyo, Japan --

Signed and Sealed this

*Twenty-third* Day of *September 1986*

[SEAL]

*Attest:*

DONALD J. QUIGG

*Attesting Officer*

*Commissioner of Patents and Trademarks*